United States Patent [19]

Atherton et al.

[11] Patent Number: 4,562,351

[45] Date of Patent: Dec. 31, 1985

[54] SAMPLE INTRODUCTION DEVICE FOR MASS SPECTROMETERS

[75] Inventors: Paul Atherton, Altrincham; Peter Burns, Stockport; Brian N. Green, Sale, all of England

[73] Assignee: VG Instruments Group Limited, England

[21] Appl. No.: 550,189

[22] Filed: Nov. 9, 1983

[30] Foreign Application Priority Data

Nov. 9, 1982 [GB] United Kingdom ..... 8231979

[51] Int. Cl.[4] ..... H01J 49/04

[52] U.S. Cl. ..... 250/288; 250/423 R; 250/423 F

[58] Field of Search ..... 250/288, 281, 282, 423, 250/423 F, 427

[56] References Cited

PUBLICATIONS

Occolowitz, J. L.; Landis, P. W., 30th An. Confr. on Mass Spectrom. and Allied Topics, Honolulu, Jun. 1982, pp. 562–563.

Alberth, W.; Straub, K. M.; Burlingame, A. L., Analytical Chemistry, 1982, 54, 2029–2034 (Oct.).

Abstract from Instruction Manual for VG ZAB Mass Spectrometer, produced by VG Analytical Limited.

Svec et al., "A Mass Spectrometer . . . ", *J. Sci. Instrum.*, vol. 43, No. 3, Mar. 1966, pp. 134–137.

*Primary Examiner*—Alfred E. Smith
*Assistant Examiner*—Jack I. Berman
*Attorney, Agent, or Firm*—Bacon & Thomas

[57] ABSTRACT

The invention consists of a mass spectrometer having a sample insertion probe on which a reference compound and an unknown sample can be simultaneously introduced without mixing into a field ionization or ion or neutral particle bombardment ion source. An insulated support is mounted by a parallel hinge on the end of the probe shaft. Two or more separated segments or emitter wires, one carrying the unknown sample, another carrying an appropriate reference compound, are mounted on a base member which is fitted to the support. A drive shaft, concentric with the outer probe shaft, has an eccentric peg on the end, which engages with a cam on the support, so that rotation of the drive shaft results in an oscillating motion of the segments or emitters, alternately positioning them in the optimum position for ionization. A spectrum of the sample or the reference compound can be obtained when required by selecting the appropriate position of the drive shaft. Rotation of the drive shaft may be controlled by a servo- mechanism and a computer. As a result, improved accuracy of mass measurement of peaks in the mass spectrum of the sample is achieved.

8 Claims, 5 Drawing Figures

SAMPLE INTRODUCTION DEVICE FOR MASS SPECTROMETERS

TECHNICAL FIELD

This invention relates to the introduction of samples into mass spectrometers, and in particular, mass spectrometers used for the analysis of complex organic substances, especially those of high molecular weight.

BACKGROUND ART

Mass spectrometers suitable for the analysis of complex organic compounds are well known in the art and may incorporate mass filters of either the quadrupole or the magnetic sector type. The latter type may also incorporate an electrostatic filter in addition to the magnetic sector mass analyser, and this type of double focusing instrument is generally capable of higher mass resolution than a single focusing magnetic sector or quadrupole filter instrument.

Recently, instruments with more than one mass or momentum analysis filter have been constructed, and these have been found to have some advantages for the analysis of complex organic compounds, and especially mixtures of compounds. Instruments of this type commonly incorporate three quadrupole filters; a magnetic sector, electrostatic sector, and a quadrupole filter; two magnetic sectors and an electrostatic sector; or other combinations. The invention to be described is applicable to all these forms of spectrometers, and to any other form which utilises an ion source similar to those described.

An important problem frequently encountered in the mass spectrometric analysis of organic compounds is the ionization without excessive decomposition of thermally unstable or involatile samples. This is particularly important in the analysis of biochemical samples, because many important biochemicals fall into these categories. Many solutions to this problem have been proposed, including field ionization and desorption, atmospheric pressure ionization, electrohydrodynamic ionization, secondary ion mass spectrometry involving bombardment by ions, neutral particles, or laser radiation, etc., and many others. All these methods of ionization are capable of producing ions of very high mass from organic compounds, in some cases greater than 5000 daltons, which makes severe demands on the stability and calibration of the spectrometer mass analysing filters, especially at high resolution, and when accurate mass determinations are required. It has always been necessary to calibrate the mass scale of a mass spectrometer, usually by means of a reference compound which yields a spectrum consisting of peaks of accurately known mass, and this becomes very important if accurate mass measurements (as opposed to mass numbers) are wanted. When accurate mass measurements at very high mass are required, the selection of a suitable reference compound becomes one of the most difficult features of the analysis, especially because the reference compounds themselves tend to be difficult to ionize. In many cases the absence of a suitable high mass reference compound severely limits the applications of the "soft" ionization sources mentioned above.

A conventional calibration procedure suitable for accurate mass measurement of organic compounds at high resolution involves the simultaneous introduction of the sample and the reference compound into the ion source, so that the spectrum produced consists of peaks due to both compounds. The precise masses of the peaks due to the sample can then be calculated by interpolation between peaks of accurately known masses due to the reference compound. This can be done manually by examining a recording of the spectrum, or more usually by means of a computer programmed to perform the interpolation during a mass scan of the spectrometer, using the time of arrival of the peaks relative to the start of the scan as a measure of their mass. Alternatively, the technique of peak matching can be used. In peak matching, the spectrometer is switched rapidly and repetitively between a reference peak and a sample peak, and a narrow scan is made about the centre of each mass so that each peak can be displayed in turn on a long persistence oscilloscope. The ratio of the voltages required to superimpose the peaks can then be used to determine accurately the mass ratio of the two peaks. All these techniques are well known and need not be described further.

In the case of secondary ion organic mass spectrometry sources, such as those involving bombardment of the sample with a beam of ions, neutral particles, or light, etc, the simultaneous introduction of a reference compound and a sample can present a number of difficulties. For example, in the case of bombardment by neutral atoms of Argon of between 2 and 6 Kev energy, it has been found that the best results are obtained when the sample is dissolved in a medium of high viscosity and low volatility such as glycerol, and this solution is then coated on the target in the mass spectrometer source. If a reference compound is to be added to this solution it is essential that it too will dissolve in the medium chosen for the sample, and this can seriously limit the choice of reference componds. The high mass reference compounds most commonly used with conventional modes of ionization, i.e, triazine compounds and "Fomblin" (U.K. Registered Trade Mark) oil cannot be simultaneously introduced with a sample in neutral atom bombardment spectrometery because they are insoluble in glycerol and glycerol-like media. Consequently, very weak or even wholly indistinct spectra are obtained under these conditions. Sometimes it is possible to use the medium itself as a source of reference peaks, but these are usually limited to the low mass ranges. It is also sometimes possible to select a reference compound which is miscible with the medium chosen for the sample, but compounds selected in this way often have other disadvantages such as a relatively small number of useful peaks in the spectrum, and are usually only useful with a particular sample or class of sample. A further problem frequently arises from the apparent supression of the ionization of the sample by a reference compound dissolved in the same medium, or of the ionization of the reference compound by the sample. This effect is frequently observed in neutral particle and ion bombardment mass spectroscopies.

Similar problems of calibration are also encountered with field desorption ion sources, where a sample is coated on an emitter wire which is introduced into a field ionization mass spectrometer.

Attempts have been made to overcome these problems by the use of special targets which separate the sample and the reference compounds to prevent them from mixing. In one prior target assembly, two or more individual targets, one coated with the sample and another coated with the reference compound, are simultaneously bombarded by the primary beam, so that an ion beam containing ions from both the sample and the reference compounds is produced. This method suffers from the disadvantage that by its nature, the sample and the reference compound cannot both be positioned on the optical axis of the spectrometer, and usually both are displaced. This results in a serious loss in sensitivity on at least one of the samples, or, if a compromise position is adopted, a significant loss on both. In addition, with most practical forms of high resolution double focusing mass spectrometers, and especially with an instrument which is slightly out of adjustment, ions formed away from the optical axis of the instrument and which pass through the entrance slit of the analyser portion, can appear at an incorrect mass position in the spectrum. The use of a target of this kind can therefore result in the great majority of the ions being formed off the optical axis, so that the resultant peaks may appear at an incorrect mass position and a serious error is introduced.

An alternative known form of target consists of a rotatable shaft with two contiguous faces arranged in the manner of a wedge. The sample is coated on one face of the target, the reference on the other, and the shaft is positioned in the source so that one of the faces is in the correct position for conventional operation. In order to change from the sample to the reference compound, or v.v, the shaft is simply rotated through 180°. This simple device suffers from the disadvantage that the two faces are not completely isolated from each other, so that mixing of the sample and reference compounds can occur whilst the shaft is in use. It is also difficult to operate automatically, especially quickly, because of the force exerted by the vacuum lock seals on the shaft of the probe and the presence of various guide rods and safety devices which are usually fitted to conventional insertion probes in order to ensure safe operation of the probe and to prevent it rotating in normal use. Further, it is often difficult to arrange mechanically, because it is necessary that the angled face of the target is correctly orientated towards both the primary beam and the optical axis of the spectrometer. This requirement largely determines the angle and position at which the shaft must enter the source housing, and the physical layout of many mass spectrometers very frequently precludes the use of a device of this kind without major modification of the source housing of the spectrometer.

It is an object of the present invention to provide apparatus for introducing samples and reference compounds into an ion or neutral particle bombardment source mass spectrometer in which these difficulties are overcome, and which can easily be fitted to most known types of spectrometer which have an insertion probe for the introduction of a sample coated on a target, thereby facilitating the accurate mass determination, especially at high mass, of the peaks in the spectrum of a sample, and in particular, a sample of high molecular weight of a compound of biological importance which is difficult to ionize by conventional methods.

It is another object of the invention to provide apparatus for introducing emitter wires loaded with sample or reference compounds into the source of a field ionization or field desorption mass spectrometer which operates in a similar manner.

SUMMARY OF THE INVENTION

According to one aspect of invention there is provided apparatus for carrying samples in the source of a mass spectrometer comprising a sample carrier which consists of a plurality of non-contiguous elements on which a sample or a reference compound may be coated, in which each of said elements is separately mounted from a supporting means which is provided with a moving means capable of fast operation in comparison with the selected scan or cycle time of said spectrometer, whereby each element may be moved in turn to the optimum position within said source for the ionization of said sample or reference compound and for the ions so generated to be analysed by said mass spectrometer.

The invention is especially useful with a secondary ion mass spectrometer in which the sample is coated on a target and ionized by bombardment with a beam of ions, neutral atoms or molecules, electromagnetic radiation, or sub-atomic particles. In this case the carrier preferably consists of segments having an elongate plate-like form which are each coated with an individual sample or reference compound preferably, but not essentially, dissolved in a suitable solvent of low volatility and high viscosity such as a glycol or glycerol. The segments are non-contiguous, preferably being mounted in such a way as to leave a gap between the sides of adjacent segments which is just sufficiently wide to prevent mixing of the samples deposited on the segments. The moving means with which the said supporting means is provided are suitably such as to allow each segment to be brought in turn and reproducibly to an optimum position in the bombardment source. Preferably the target should consist of two segments arranged so that the gap between them is parallel to the long axis of the mass spectrometer analyser entrance slit. The extent of travel of the moving means should be limited so that at each end of its travel, one segment of the target is positioned with its centre line on the optical axis of the spectrometer. Preferably, the direction of motion of the segments should be in a plane parallel with that of the spectrometer analyser entrance slit plate, and at right angles to the long axis of the spectrometer slits. This results in the greater sensitivity because a greater area of the target segments can be utilized effectively. However, a direction of motion in the same plane but in the direction of the long axis of the slit can be used if it is more convenient to arrange.

It is also preferable that the said supporting means should be mounted on a probe assembly which can be inserted through a vacuum lock into the source housing of the spectrometer. The probe may be similar to those conventionally used to introduce samples into mass spectrometers, or more particularly, to those used for introducing field desorption emitters into a field desorption mass spectrometer, being adapted to position the sample carrier in the proper place in the bombardment source. The use of such a probe allows the sample carrier to be withdrawn from and replaced in the source for changing samples without admitting air into the spectrometer. Mechanical adjusting means, for example a pair of bellows sealed linear motion drives mounted on the source housing, may be provided to adjust the position of the target assembly. Preferably the target support means is flexibly or slideably mounted on the end of the probe so that the segment positions can be changed simply by deflecting the target support means.

The moving means preferably comprise a drive rod concentric with the probe shaft fitted with an eccentric which drives a cam on the target support means, so that rotation of the drive rod results in an oscillating motion of the target which alternately positions the segments on the optical axis of the spectrometer. An alternative moving means consists of a solenoid or other pushing means adapted to push the target support means to locate one of the two segments on the optical axis. The flexible mounting of the target support means may be made resilient, and be biased to maintain the other segment on the optical axis when the solenoid is released. In such an arrangement the supporting means may conveniently be mounted on said probe by means of a parallel hinge comprising two flexible elongate thin strips with their largest faces parallel to one another fixed at one end to said supporting means and at the other to said probe.

Preferably also the supporting means should be made of an electrical insulator through which at least two electrical conductors run, which may also serve to support the segments so that an electrical current may be passed through them in order to heat them to any desired temperature. The same circuit can also be used to maintain the segments at the potential required for the proper operation of the mass spectrometer. The conductors in the supporting means may be connected to contacts which are adapted to touch contact wipers in the source when the probe is inserted. It is also advantageous to mount the segments on an insulating base member instead of directly on the supporting means. The conductors in the supporting means are then connected to sockets which are adapted to receive pins on the base member which extend through the base to support the segments. This arrangement allows the easy removal of the base member and segments from the probe for cleaning and sample loading, etc. If the conductors, pins, sockets and contact wipers are additionally of good thermal conductivity, then the segments may alternatively be cooled by removing heat from the wipers by any convenient method.

Preferably also the operation of the said moving means should be carried out automatically, for example by a computer programmed to control the operation of the mass spectrometer. For example, if the spectrometer is used in the peak matching mode, the computer may be programmed to change the segment positions each time the spectrometer is switched from the reference mass to the unknown mass. Alternatively, if the spectrometer is being operated in the scanning mode, the computer can be programmed to run a spectrum of the reference compund as often as required simply by changing the target positions immediately before the next scan is made. However, manual operation of the invention is also useful simply as a matter of convenience, for example if two unknown samples are introduced on the target.

It is also advantageous to use the invention in conjunction with a field ionization or field desorption mass spectrometer. Calibration of a spectrometer of this type presents similar problems to the calibration of a secondary ion mass spectrometer, especially at high mass, and similar problems are encountered if an attempt is made to introduce both a sample and a reference compound on the same emitter. In the case of a field desorption spectrometer, the non-contiguous elements of the invention consist of a plurality of emitter means, e.g. emitter wires, which are separately supported from the supporting means. Preferably each emitter wire consists of a thin tungsten wire activated in accordance with known procedures and coated with the sample to be analysed or a reference compound. Each emitter wire should also be supported on two electrically conducting legs so that an electrical current can be passed through it in order to heat it, and so that the electrical potential of the emitter can be maintained at the desired value. Preferably also two emitters are provided, one coated with the sample to be analysed, the other coated with a suitable reference compound. All the remaining features of the previously described embodiment of the invention are equally applicable to this form using field desorption emitters.

It will be appreciated that the use of the invention with either a secondary ion mass spectrometer or a field ionization mass spectrometer allows a greater accuracy of mass measurement of the peaks in a spectrum to be achieved. The reference compound is loaded on one target segment or emitter, and the sample on another. Spectra of the reference compound or the sample may then be obtained in rapid succession without altering the adjustment of the spectrometer, simply by changing the positions of the segments or emitters. Thus use of the invention is almost equivalent to the simultaneous introduction and ionization of the sample and reference compounds, as is usually done in conventional electron impact or chemical ionization mass spectrometery, without the problems which would result from actually mixing them. The spectrometer can also be used in the peak matching mode, changing from the sample to the reference compound, or v.v, each time the mass is changed.

According to a further aspect of the invention there is provided a mass spectrometer suitable for the accurate determination of the mass of peaks in the mass spectrum of a sample, said spectrometer having an ion source equipped for the ionization of a sample coated on a target by bombardment with a beam of ions, neutral atoms or molecules, electromagnetic radiation or subatomic particles, and apparatus for carrying samples according to the invention.

According to a yet further aspect of the invention there is provided a mass spectrometer suitable for the accurate determination of the mass of peaks in the mass spectrum of a sample, said spectrometer having an ion source equipped for the ionization of samples coated on a field ionization or field desorption emitter and apparatus according for carrying samples according to the invention.

According to a yet still further aspect of the invention there is provided a method of accurately determining the masses of peaks in the spectrum of a sample by means of a mass spectrometer having apparatus for carrying samples according to the invention comprising:

(a) coating said sample on one of said non-contiguous elements;

(b) coating a suitable reference compound on another of said non-contiguous elements;

(c) recording at least a part of the mass spectrum of the sample and the reference compound as frequently and as often as necessary to obtain the desired accuracy of mass measurement of the peaks in the spectrum of the sample, by quickly changing the positions of said non-contiguous elements so that either the sample or the reference compound, as required, is positioned in the source of the mass spectrometer in the optimum position for the ions emitted from it to be analysed by said mass spectrometer.

DESCRIPTION OF THE DRAWINGS

Some examples of the apparatus of the present invention suitable for use with a secondary ion mass spectrometer will now be described by way of example with reference to the accompanying drawings in which.

DETAILED DESCRIPTION OF THE INVENTION

Figure 1:
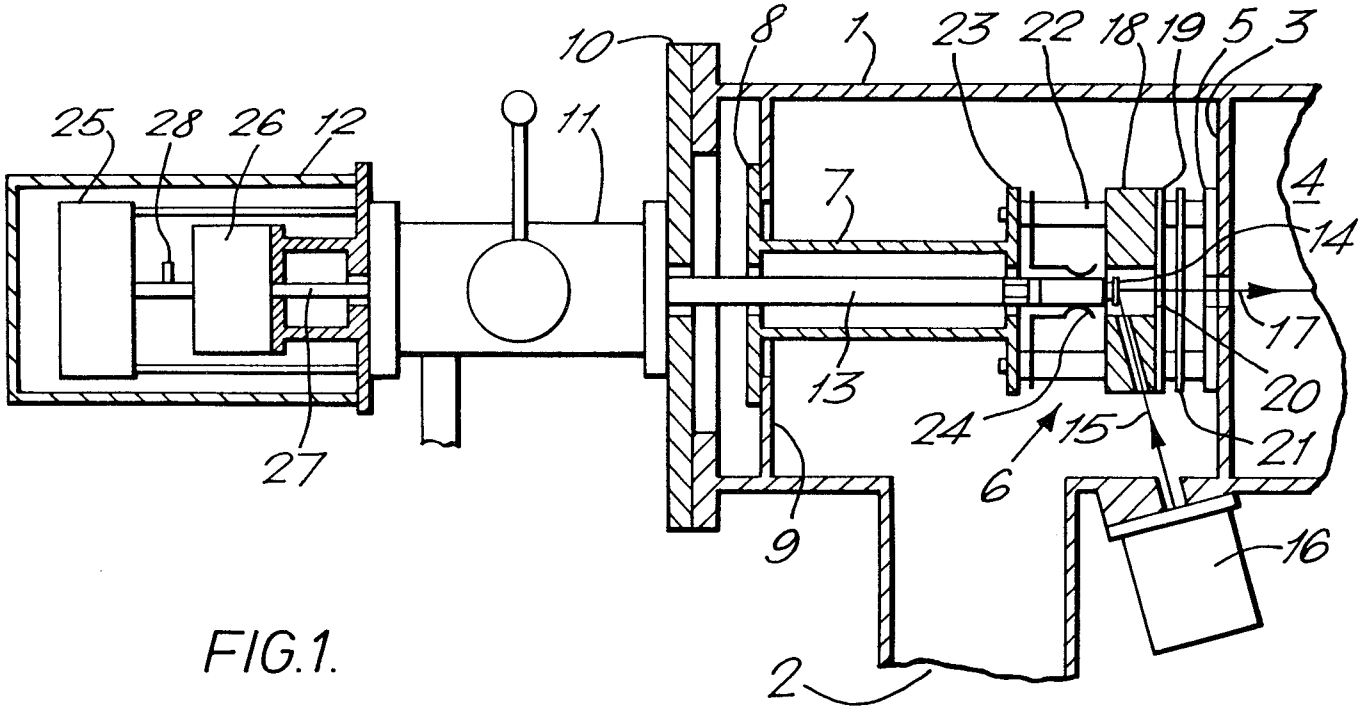
FIG. 1 is a schematic sectional drawing of a secondary ion mass spectrometer incorporating an apparatus according to the invention.

Referring first to FIG. 1, the source housing 1 the mass spectrometer is evacuated through port 2, and diaphragm 3 separates the source region of the spectrometer from the analyser region 4 and carries the analyser entrance slit assembly 5. A secondary ion source generally indicated by 6 is supported by tube 7 and flange 8 from diaphragm 9. Source housing end flange 10 is fitted with a conventional vacuum lock 11 through which a long sample introduction probe 12 is fitted. The shaft 13 of probe 12 carries a target assembly 14 which is bombarded by a beam 15 of neutral particles, ions, or light, etc, from gun 16 mounted on housing 1, so that secondary ions emitted from the sample coated on target 14 follow trajectory 17 through entrance slit 5 into the analyser 4. The remainder of the ion source 6 consists of ion chamber 18 which is drilled to admit probe shaft 13 and the beam 15, and which is fitted with plate 19 containing slit 20 through which the secondary ions pass after leaving the target. A pair of beam deflecting plates 21 are mounted between slit plate 19 and slit 5, with the gap between them aligned with the long axis of slits 5 and 20. These plates are fitted to conventional secondary ion sources and may be used to correct for accidental misalignment of the target and slit systems. The potential of plate 19, and the average potential of plates 21, may be adjusted to accurately focus the ion beam on to slit 5 and maximise the sensitivity. Ion chamber 18 may also be provided with other inlet ports for conventional inlet systems such as a second insertion probe, or a gas chromatograph, etc. It may also be fitted with a heated filament and other parts to enable the source to be used for the production of conventional electron bombardment spectra. Chamber 18, plate 19, and deflection plates 21 are supported by 4 insulated rods and spaced apart by insulating spacers 22, from the baseplate 23 which in turn is attached to tube 7. The rods and spacers 22 are preferably made of ceramic, whilst most other parts of the source should be of stainless steel. The rods and spacers 22 also support two wiping contacts 24 which carry electrical current to the target 14 as described previously.

Probe 12 which is used to introduce target 14 into source 6 passes through a conventional vacuum lock 11 which is mounted on source end flange 10. This allows the target to be withdrawn for sample changing and cleaning without admitting air into the spectrometer. The mechanism to be described below is actuated by a motor or other suitable actuating means 25 which is coupled to drive rod 27 which runs through the centre of shaft 13. Drive rod 27 passes through a rotating shaft seal 26, the outer part of which is attached in a vacuum tight manner to shaft 13 so that air is prevented from passing into the source housing through the annular space between rod 27 and hollow shaft 13. Shaft 27 also carries an actuating peg 28 which is used to actuate limit switches (not shown) which may conveniently be electrical microswitches. Alternatively, a special multi-purpose switch driven by shaft 27 can be used. The limit switches are arranged to stop the rotation of shaft 27 every 180° by disconnecting power to motor 25. The positions in which the shaft stops are arranged to correspond with the extreme ends of the target travel. A third switch is also provided to stop the shaft rotation at 90° to these positions, where the target is in mid position, to enable the probe to be withdrawn through the vacuum lock. Alternatively a servo-mechanism incorporating a motor and a position sensing device may be used in place of the conventional motor and limit switches described.

Figure 2:
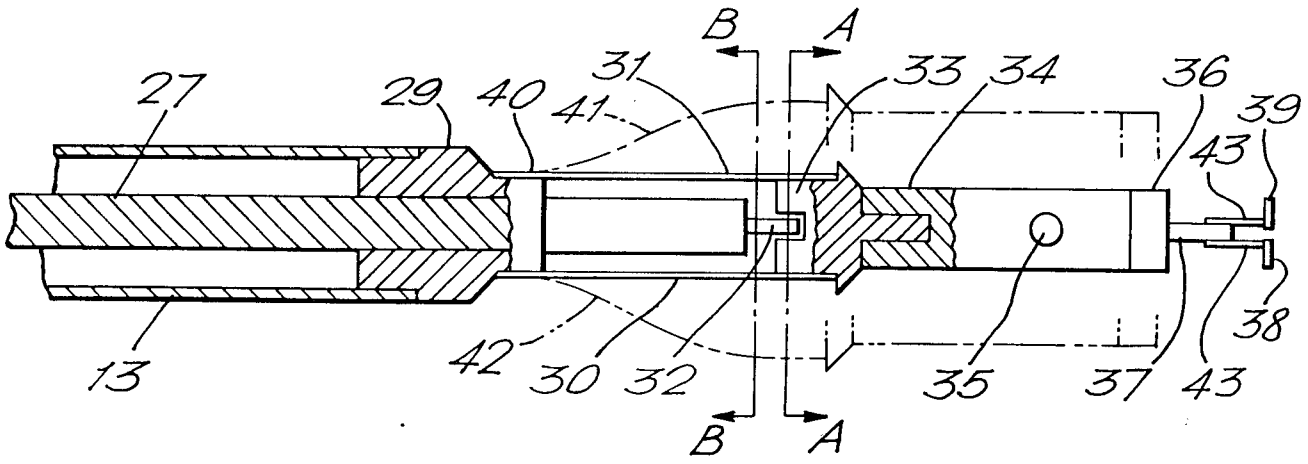
FIG. 2 is a partial and partly sectioned view of an insertion probe suitable for use with the apparatus of the invention.

Referring now to FIG. 2, which is a sectional view of the end of the insertion probe and target, the end of shaft 13 is closed by a plug 29 which is bored to act as a bearing for shaft 27. To minimize the friction between the drive rod and the bearing, drive rod 27 should preferably be silver plated, at least along the length that passes through plug 29. This eliminates the tendency for the rod to jam in the bearing which might otherwise occur with prolonged operation in a vacuum. Two parallel flats 40 are provided on the outer surface of plug 29, and two thin rectangular strips of resilient material 30 and 31 are attached to flats 40. A cam 33 is attached to the other ends of strips 30 and 31, which are adjusted to maintain cam 31 on the centre line of probe shaft 13 in the absence of any force applied to them. An eccentric peg 32 on the end of drive rod 27 engages with a slot in cam 33 and alternately deflects spring strips 30 and 31 to the extreme positions indicated by 42 and 41, respectively, moving target support means 34 to the positions shown in FIG. 2. Because both springs 30 and 31 are attached at each end to plug 29 and cam 33, they form a simple parallel hinge, and the faces of the target segments 38 and 39 remain in a plane at right angles to the probe axis at all times. The amplitude of this motion is arranged so that target segment 39 is centered on the probe axis when the springs are deflected into position 42, and segment 38 is on the axis when the springs are deflected into position 41. The range of motion indicated in FIG. 2 is exagerated for clarity. Thus rotation of rod 27 results in the alternate positioning of the two target segments on the spectrometer optical axis as required by the invention. This type of motion does of course result in the target segments moving slightly backwards in comparison with the centre position, but the effect is small, and is in any case irrelevant when a 2 segment target is used because the spectrometer is only operated with the probe in one of the extreme positions which lie in the same plane. There is no need therefore to readjust the focus of the mass spectrometer when the segments are changed.

Cam 33 carries a target support means which is preferably made from an insulator such as alumina ceramic. This carries two contacts 35 which touch the wipers 24 (FIG. 1) when the probe is inserted. As shown in FIGS.

2 and 3, which show the probe end from viewpoints at right angles to each other, each segment 38 and 39 is supported by two legs 43, one of each pair of which is attached to a pin 37 which passes through and is supported by the base 36. The gap between segments 38 and 39 is just sufficient to eliminate the possibility of mixing of the solvents deposited on each segment. The legs 43 are made as small as possible, subject to the requirements of adequate electrical and thermal conductivity, to minimize the creep of viscous solvent from one segment to the other via the legs 43 and pin 37. In certain cases it may not be possible to obtain the desired angle of bombardment of the target by the primary beam if the segments 38 and 39 are fitted as shown in the drawings. If necessary, the angle can be adjusted by making one of the pair of legs 43 on each segment shorter than the other. If the angle in the other plane is to be altered, the segments can be fitted at any desired angle on the legs.

Figure 3:
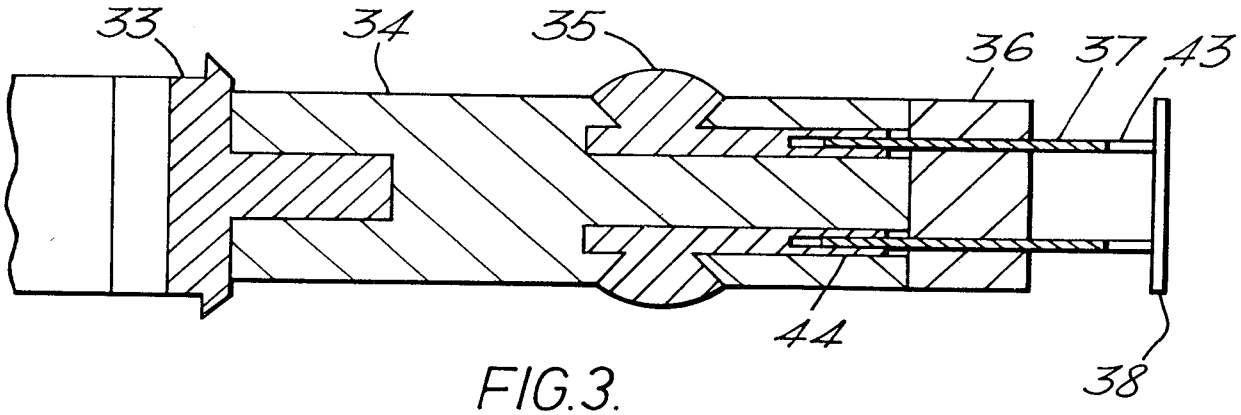
FIG. 3 is a further sectional view of part of the probe shown in FIG. 2.

The pins 37 are a push fit in sockets 44 in the target support means 34, to allow the easy removal of the target from the end of the probe. As shown in FIG. 3, an electrical current can be passed through contacts 35, sockets 44, pins 37 and legs 43 through each of the target segments. This can be used to heat the segments if required. If these components are also made from material of good thermal conductivity, the target can be cooled by removing heat from contacts 35 via wipers 24. Wipers 24 can be cooled by any appropriate means, e.g, oil or water circulation, a heat pipe to an external heat sink, or by a device utilising the thermoelectric effect. The target segments are also maintained at the mass spectrometer accelerating voltage by connection to wipers 24. It is important that these wipers are disposed in the plane shown in the drawings. Contacts 35 are located on an axis parallel to the long axis of the spectrometer slits, and the probe is arranged so that the motion imparted to the target is at right angles to that axis. Wipers 24 are made sufficiently wide to accomodate the motion of contacts 35, which move with the support 34, so that contact is maintained uniformly irrespective of the position of the target.

Figure 5:
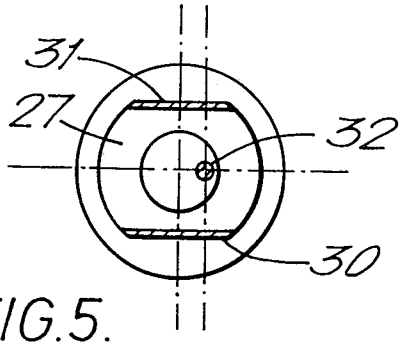
FIG. 5 is a sectional view along the plane BB in FIG. 2 in the direction of the arrows.
Figure 4:
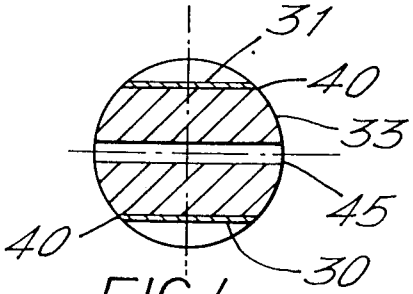
FIG. 4 is a sectional view along the plane AA in FIG. 2 the direction of the arrows.

A suitable form of eccentric and cam is illustrated in FIGS. 4 and 5, which are sectional views along planes AA and BB in FIG. 2 respectively. Cam 33 (FIG. 4), consists simply of a slot 45 cut diametrically across the face. This slot is engaged by a peg 32 positioned eccentrically on the end of drive shaft 27(FIG. 5). This method of deriving the motion of the target has the advantage that the motion of the target for a given angular rotation of the drive shaft is smallest at the extreme ends of the target travel, where the greatest accuracy of positioning is required. The need for very accurate registration of the drive shaft position is therefore minimized. Similarly, for a constant speed of rotation of the shaft, the target is accelerated slowly away from one extreme position and decelerated slowly towards the other position because of the sinusodial motion imparted to the target. This minimises the tendency for the solvent to be displaced from the target as it is moved from rest.

Other moving means can also be employed to deflect the target position as described previously. However, it is necessary that whatever means are provided, they are capable of operating in a very short time in comparison with the scan time or the cycle time of the mass spectrometer. For this reason, mechanisms based on a screw driven linear positioner are generally considered unsuitable, especially for automatic operation.

The design of suitable circuits to control the positioning of shaft 27 to ensure proper location of the target segments, based on limit switches or other forms of positional sensors, e.g, optical or electromagnetic, or of a control system for a servo-mechanism, will present no difficulty to those skilled in the art. It is also a simple matter to control the rotation of shaft 27 when provided with these sensors or a servo-mechanism, so that on receipt of a suitable signal from the spectrometer computer or control system, the target position is changed automatically.

It will be appreciated that a reference compound need not always be used in order to gain advantage from the invention. For example, two unknown samples could be used, when the accuracy requirements were such that a reference compound was not required, in order to reduce the number of operations needed to obtain spectra from two samples. Similarly, the number of segments in a target could be increased to 3 or more, with suitable modifications to the positioning system of the drive shaft. Thus two samples and one reference compound, or three samples, could be introduced in one operation, with a saving in operating time.

The modifications needed to use this embodiment in conjunction with a field ionization or field desorption source are relatively minor. It is only necessary to substitute a holder carrying two or more activated field desorption emitters in place of the target segments 38 and 39. Atom or ion gun 16 is no longer required, but instead, an extraction electrode is provided in source 6 in the manner of a conventional field desorption source. Two samples, or one sample and a reference compound can then be loaded on the wires, and the invention operated in the manner described. As many problems encountered in field desorption mass spectroscopy are very similar to those in secondary ion mass spectroscopy used in the way described, the invention can extend the versatility, sensitivity and accuracy of this technique exactly as it does for secondary ion mass spectroscopy.

What is claimed is:

1. A mass spectrometer having an ion source and means for carrying samples in said ion source comprising:

(a) supporting means from which a plurality of non-contiguous elements are separately mounted and on each of which elements a sample may be coated;

(b) a connecting means connecting said supporting means to an insertion probe and permitting said supporting means to move relative to said insertion probe; and (c) a drive mechanism arranged and adapted to move said supporting means relative to said insertion probe to cause each of said elements to be brought in turn to an optimum position within said ion source for the ionization of said sample to be effected and for the ions so generated to be analysed by the mass spectrometer; said insertion probe, supporting means, connecting means and drive mechanism further being adapted to permit their insertion into and withdrawal from said ion source through a vacuum lock in at least one position of said supporting means relative to said insertion probe and without admitting air into said ion source.

2. A mass spectrometer according to claim 1 arranged for ionization of said sample by bombardment with a beam of ions, neutral atoms or molecules and in which said elements are of elongate plate-like form, supported from said supporting means with a gap between them just sufficiently wide to prevent mixing of the samples deposited on them.

3. A mass spectrometer according to claim 1 arranged for ionization of said samples by an electrical field, and in which said elements comprise emitters suitable for carrying samples in a field ionization or field desorption ion source.

4. A mass spectrometer having an ion source and means for carrying samples in said ion source comprising:

(a) a supporting means from which a plurality of noncontiguous elements are separately mounted and on each of which elements a sample may be coated;

(b) a connecting means connecting said supporting means to an insertion probe and permitting said supporting means to move along substantially only one axis relative to said insertion probe;

(c) a cam provided on said supporting means, said cam engaging an eccentric peg on the end of a drive shaft which is concentric with said insertion probe; and (d) a driving means for rotating said drive shaft;

said cam and said peg being so dimensioned that rotation of said drive shaft results in an oscillating motion of said supporting means which alternately positions said elements in said ion source in the optimum position for the ionization of said sample and for the ions so generated to be analysed by the mass spectrometer, and said insertion probe, supporting means, connecting means, cam and peg further being adapted to permit their insertion into and withdrawal from said ion source through a vacuum lock in at least one position of said supporting means relative to said insertion probe and without admitting air into said ion source.

5. A mass spectrometer having an ion source and means for carrying samples in said ion source comprising:

(a) a supporting means from which a plurality of noncontiguous elements are separately mounted and on each of which elements a sample may be coated;

(b) a parallel motion solid hinge comprising two flexible elongate thin strips disposed with their largest faces parallel to one another, fixed at one end to said supporting means and at the other end to an insertion probe thereby to permit said supporting means to move relative to said insertion probe; and (c) a drive mechanism arranged and adapted to move said supporting means relative to said insertion probe to cause each of said elements to be brought in turn to an optimum position within said ion source for the ionization of said sample to be effected and the ions so generated to be analysed by the mass spectrometer;

said insertion probe, supporting means, parallel motion solid hinge and drive mechanism further being adapted to permit their insertion into and withdrawal from said ion source through a vacuum lock in at least one position of said supporting means relative to said insertion probe and without admitting air into said ion source.

6. A mass spectrometer according to claim 5 in which said drive mechanism comprises a cam provided on said supporting means, said cam engaging an eccentric peg on the end of a drive shaft which is concentric with said insertion probe, said cam and peg being adapted to cause an oscillatory motion of said supporting means when said drive shaft is rotated.

7. A mass spectrometer according to claim 6 in which said elements are separately mounted from a base member having a plurality of pins arranged to mate with sockets in said supporting means.

8. A mass spectrometer according to claim 6 in which said supporting means is an electrical insulator through which a plurality of electrical conductors pass, said conductors serving both to support said elements from said supporting means and to permit an electrical current to be passed through said elements in order to heat them and to permit them to be maintained at a desired electrical potential.

* * * * *